United States Patent [19]

Zakheim et al.

[11] Patent Number: 5,022,592

[45] Date of Patent: Jun. 11, 1991

[54] MAGNETIC MEDIA MILL

[75] Inventors: Howard Zakheim, Bala Cynwyd; Peter M. Clinton, Media, both of Pa.; James D. Goldschneider, Newark, Del.; Christopher A. Kasmer, Lawrenceville, N.J.; Markus Zahn, Lexington, Mass.; Charles L. Hoffmeyer, Wilmington, Del.

[73] Assignee: E. I. du Pont de Nemours and Company, Wilmington, Del.

[21] Appl. No.: 549,822

[22] Filed: Jul. 9, 1990

Related U.S. Application Data

[63] Continuation-in-part of Ser. No. 346,877, May 3, 1989, abandoned.

[51] Int. Cl.[5] ..... B02C 17/16

[52] U.S. Cl. ..... 241/172; 241/184

[58] Field of Search ..... 366/273, 274; 241/171, 241/172, 65, 66, 67, 184, 179

[56] References Cited

U.S. PATENT DOCUMENTS 2,416,746 3/1947 Gavin .

FOREIGN PATENT DOCUMENTS 888641 7/1949 Fed. Rep. of Germany .
906613 2/1982 U.S.S.R. .
1066644 1/1984 U.S.S.R. .

*Primary Examiner*—Mark Rosenbaum
*Attorney, Agent, or Firm*—John M. Lynn

[57] ABSTRACT

Media mill having a magnetic circuit of magnetic impellers on a shaft, magnetized media, and a magnetizable outer shell which provides improved efficiency.

24 Claims, 10 Drawing Sheets

24
23
SOUTH
NORTH

MAGNETIC MEDIA MILL

CROSS REFERENCE TO RELATED APPLICATION

This application is a continuation-in-part of co-pending application Ser. No. 07/346,877 filed May 3, 1989, now abandoned.

BACKGROUND OF THE INVENTION

Media mills have long been used, for example, in the milling of pigments for finishes. Such mills can be used to grind some materials, but, more typically, act to disperse the material being treated in a carrier, or deagglomerate the material to promote dispersion.

The mills typically comprise a container with a grinding medium in the container, and a rotatable agitator in the mill. The agitator generally has a central shaft onto which are mounted discs or projections which aid in producing shear. The product to be milled is introduced into the mill so as to flow from one end to the other. In a vertical mill, the flow is generally from bottom to top. As the flow proceeds through the grinding medium, the combination of the flow and the rotation of the agitator causes the medium to become suspended in the fluid, and, through the flow difference between the grinding media and the product in the mill, deagglomerates or disperses the pigment or other material.

In mills of this type, it would be desireable to improve the milling efficiency, for example, through lower processing times, increased flow and finer particles.

SUMMARY OF THE INVENTION

The present invention provides a media mill that provides faster and more efficient milling performance than has heretofore been attainable with conventional media mills. In addition, it has been found that a more cost effective, finer particle pigment dispersion can be obtained.

Specifically, the instant invention provides, in a media mill of the type comprising a magnetizable container, a rotatable multi-polar magnetic agitator within the magnetic container, the agitator having a central shaft and a plurality of magnetic impellers on the shaft, and media within the container, the improvement wherein the media are magnetized, and wherein the media particles are present in such quantity as to provide a media volume of at least about 25%. More specifically, the media are part of a magnetic circuit including a magnetizable outer shell and multi-pole magnetic agitator.

DETAILED DESCRIPTION OF THE INVENTION

Figure 1:
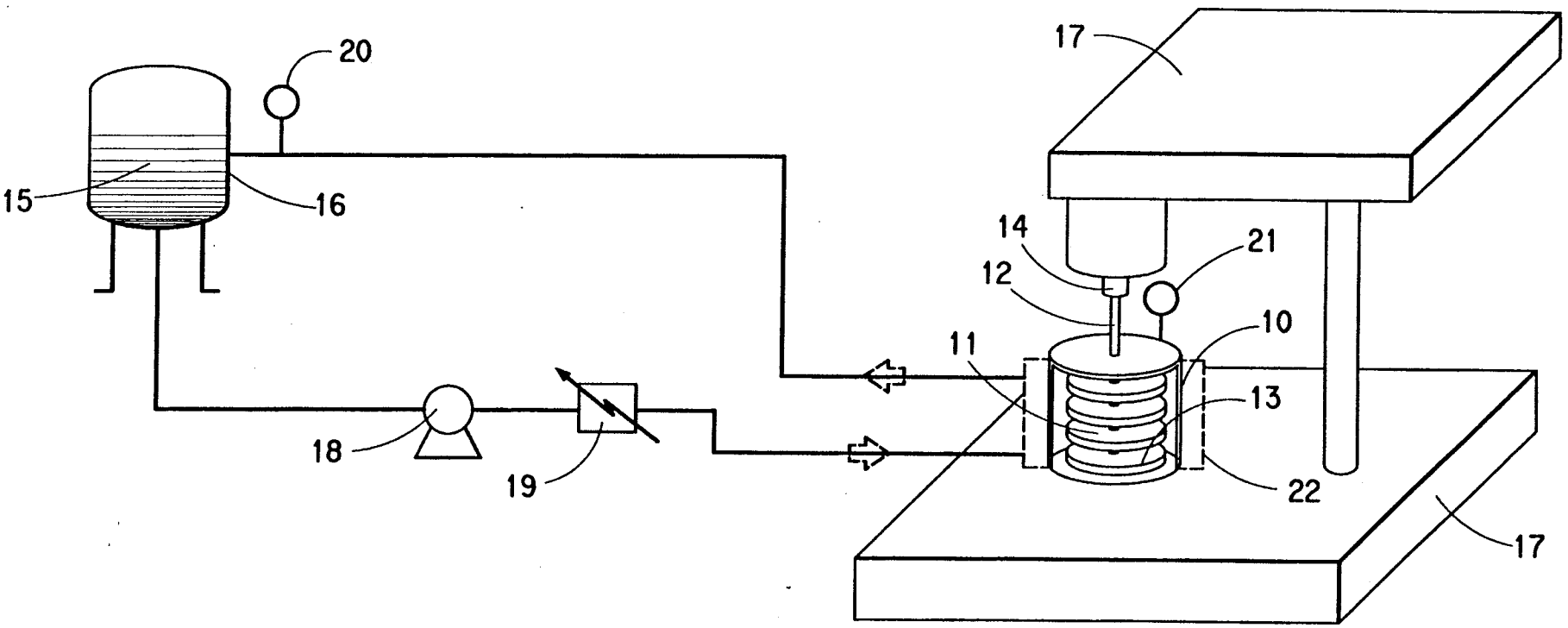
FIG. 1 is a schematic representation of a batch media mill of the present invention (showing support means and the cooling system), using permanent magnets as impellers on the shaft to magnetize the media.

The present invention can be more fully understood by reference to the figures, in which FIG. 1 is a schematic cross-sectional representation of a magnetic media mill. While the mill shown is a vertical mill, the present invention is equally applicable to horizontal mills. The mill shown in FIG. 1 is a batch mill. The mill has the general configuration of a right circular cylinder, comprising magnetizable outer shell 10 having rotatable multi-pole magnetic agitator 11 positioned in the shell. Either permanent or electromagnets can be used on agitator 11. Electromagnets can be driven by dc or ac currents. Permanent or electromagnets can be axially or radially magnetized. The agitator has central shaft 12 and impellers 13 mounted thereon. The shape of the impellers will vary with the overall design of the mill, the degree of shear desired and the intended use of the mill, and can include, for example, fingers or discs. Some or all of the fingers or discs can be magnetic. Such discs can be concentrically or eccentrically mounted on the shaft. In general, the impellers will extend to a sufficient diameter such that the annulus between the agitator and magnetic outer shell allows a sufficient magnetic field and shear zone in the annulus (gap when fingers are used). As an example, using commonly available magnets with a strength of about 1000 Gauss the following annulus dimensions are preferred: for a 4 inch diameter outer shell the disc diameter should be at least 3 inches (leaving a ½ inch annulus); for a 6 inch outer shell the disc diameter should be at least 5 inches (leaving a ½ inch annulus); for a 11.4 inch outer shell the disc diameter should be at least 10.4 inches (leaving a ½ inch annulus). If stronger magnets are used on the impeller, larger annulus gaps are possible.

In the addition to the media mill itself in FIG. 1, also illustrated is mechanical rotating means 14 (such as a motor or pneumatic drive) attached to shaft 12. The speed of rotation will vary with the intended use, but will typically be about from 300 to 3000 revolutions per minute. Rotational speeds which provide an impeller tip speed of at least about 1000 feet per minute and more preferably at least about 2000 feet per minute are particularly preferred when the invention is used for pigment dispersion. (Generally the higher the impeller tip speed the better). The mill and the rotating means 14 are mounted on support means 17.

The temperature of the mill is kept at a low level by circulating cooling liquid 15 through jacket 22 surrounding the mill and monitoring thermocouple 20 and thermocouple 21. The cooling liquid is stored in tank 16 and then circulated through pump 18 and refrigeration unit 19.

In accordance with the present invention, the media are magnetized, at least during the operation of the mill. The media can be prepared from a wide variety of materials that are magnetizable, that is, exhibit an induced magnetic dipole moment or are permanently magnetized. For example, metals which can be used include iron and iron alloys, as well as Alnico alloys, which typically comprise varying concentrations of aluminum, nickel, cobalt and copper.

The media can also be prepared from ceramic and rare earth materials which exhibit a permanent magnetic dipole moment. Such materials include, for example, those based, in whole or in part, on magnesium oxide, chromium oxide, strontium ferrite, barium ferrite, magnesium ferrite, neodymium, iron boron, neodymium iron boron, samarium cobalt, and those based on zirconium, such as zirconia and zirconium silicates. For the grinding of certain pigments, it may be desireable to use a magnetic media coated with non-magnetic ceramic. In the alternative, ceramic media particles can be used which are impregnated with a magnetic component, or particles can be prepared from a substantially homogeneous blend of magnetic and non-magnetic ceramic components.

Still other media which can be used in the present invention are those ferromagnetic resin compositions described in Saito, U.S. Pat. 4,462,919, hereby incorporated by reference.

The size and configuration of the media will, of course, vary with the intended application, and spherical as well as elongated shapes can be used. However, spherical media are typically used, on the basis of ready availability and effective media performance. The diameter of spherical media will, in general, be about from 0.1 to 3.0 mm. Preferably the media will have a size that does not permanently retain magnetization, for ease of cleaning.

The media can comprise some media which are not magnetic or magnetizable, so long as the concentration of such non-magnetic media is not so high as to define a discrete phase in the mill or interfere with the uniformity of the flow within the mill. In addition, individual media particles can, if desired, comprise both magnetizable and nonmagnetizable material, so long as the overall magnetic character of the media is not impaired.

The concentration of the media in the mill is also important to the overall performance. Specifically, in order to realize the benefits of the magnetization imparted to the media, the particles should be present so as to provide a media volume of at least about 25%. That is, the volume of the media particles should be equal to at least about 25% of the combined volume of the media and free space within the container of the mill. In this way, the magnetic force is believed to minimize the distance between the media particles, thereby increasing the grinding efficiency. Preferably, the media volume is at least about 35% and most preferably at least about 60%. In a horizontal mill the volume percent of the media could be even higher.

The magnetization of the media can be accomplished by a wide variety of means. The media can be permanently magnetic, or the media can be magnetized by other components in the apparatus. For example, permanent magnets can be used for the impellers in the mill, or the media can be magnetized by external inducers such as a permanent magnet or an electromagnetic coil exterior to the container of the mill. The magnets can be placed within non-magnetic or magnetic cups for greater structural strength and to prevent contamination by abrasion of the magnets. It is further possible that the impeller shaft can be permanently magnetized or magnetizable or the magnetic disks can be placed within magnetizable cups in order to improve the magnetic field distribution in the media for improved shear.

A magnetic field used to magnetize the media in the instant invention can be varying or non-varying with time and can be spatially uniform or non-uniform. Maintaining a sufficient magnetic field over a long media mill length requires the use of multiple magnets.

Substantially spatially non-uniform fields which can be used include, for example, those which vary with time, such as those induced by a pulsed magnetic source; those induced by magnetic fields sinusoidally varying with time; or by rotating permanent magnets. A spatially non-uniform magnetic field can also be provided by a travelling wave magnetic field, using either moving permanent magnets or moving direct current carrying conductors. In the alternative, a travelling wave magnetic field can be generated with no moving parts by using polyphase currents in windings distributed in space. Such an arrangement is typically found in the stator windings of induction or synchronous machines.

Magnetization of the media can be accomplished, as noted above, by the use of permanent magnets as the impellers. While a variety of metals or magnetic ceramics can be used for the construction of the impellers, metals are generally used for structural integrity and ease of fabrication of the impellers. In addition, to the magnetization of the media it is important that the container (outer shell 10 in FIG. 1) also be magnetizable in order to efficiently complete the magnetic circuit.

The non-uniformity of the magnetic field can also be increased by like magnetic poles facing each other in adjacent discs, preferably with the magnets in a magnetizable cup.

The effective level of magnetization can vary widely, depending, for example, on the size, density and loading of the media, the density and viscosity of the fluid in the mill, and the level of agitation within the mill. Any level of magnetism on the media will provide improvement in the grinding performance, up to a point where the media begins to assume a locked configuration, that is, the point at which the media particles begin to move as agglomerates rather than individual particles. At this point, a lessening of the improvement is realized. In practice, the grinding efficiency improves with magnetization until it reaches a peak, and then depreciates with increasing agglomeration of the magnetized media particles, until the media is in a completely locked configuration at a given rate of flow through the mill.

The particular level of magnetization will, as noted above, vary with the given operating conditions in a mill, and is directly related to magnetic flux density, which is measured in units of Gauss. The magnetic flux density can be measured by conventional commercially available Gaussmeters. The magnetic flux density is measured by direct contact with the surface of the media, using a Gaussmeter probe under the conditions of magnetization. In the systems evaluated, improvement in grinding performance is realized at any magnetic level up to a point at which the media particles begin to agglomerate. In these systems, little additional milling benefit is realized at magnetic flux densities on the media of greater than about 750 Gauss. Typically at above 1200 Gauss the media begin to agglomerate. With highly magnetizable media, the magnetic flux density approximately equals the magnetization of the media as measured in units of Gauss.

Higher magnetization values lead to bed locking where adjacent particles form agglomerates that cannot be broken up by the shear flow. The magnetic moment "m" of a spherical particle of radius "a" and volume "V" with magnetization "M" is $$m = MV = M4\pi a^3/3$$

The magnetic force of attraction "$f_{att}$" of two adjacent contacting particles so that the distance between centers is twice the radius ($2a$) is $$f_{att} = \frac{3\mu_o m^2}{2\pi(2a)^4} = \frac{3\mu_o m^2}{32\pi a^4} \quad (1)$$

Where $\mu \doteq 4\times 10^{-7}$ Henries/meter is the magnetic permeability of free space.

The approximate drag force, "$f_{drag}$", on a single spherical particle of radius "a" in a flow at velocity v with a fluid viscosity of is $$f_{drag} = 6\pi\eta a v \quad (1)$$

Where $\eta$ is the fluid viscosity.

Bed locking will approximately onset when the magnetic force of attraction in equation (1) just equals the flow shear force in equation (2). The approximate maximum magnetization "$M_{max}$" without bed locking is then $$\mu_o M_{max} = \left[\frac{36\mu_o \eta v}{a}\right]^{\frac{1}{2}} \quad (3)$$

The magnet strength required to produce this magnetization depends on the magnetic susceptibility of the particle. An increase in media particle susceptibility will allow a weaker strength magnet to produce the same media particle magnetization. For example, with a typical media particle of hardened carbon steel shot the typical relative magnetic susceptibility is much greater than 1000. For a shaft of 2.25 inch radius rotating at 1400 rpm, the shaft linear speed is about 1.3 meters per second. The effective medium viscosity of a bed of iron particles with diameter 0.8 mm is about 100 centipoise=0.1 newton-second/(meter)$^2$. For these parameter values the maximum particle magnetization without particle locking as given by equation (3) is about 1200 gauss. Thus the maximum magnetic field from all magnets should also be slightly less than 1200 gauss for these chosen parameters. Larger shaft rotational speeds and smaller media particles allow larger strength magnets without bed locking. As discussed above, you would want to operate as close to locking as is practical without locking in order to optimize milling efficiency (although the closer to bed locking you operate the higher the temperature).

Figure 2:
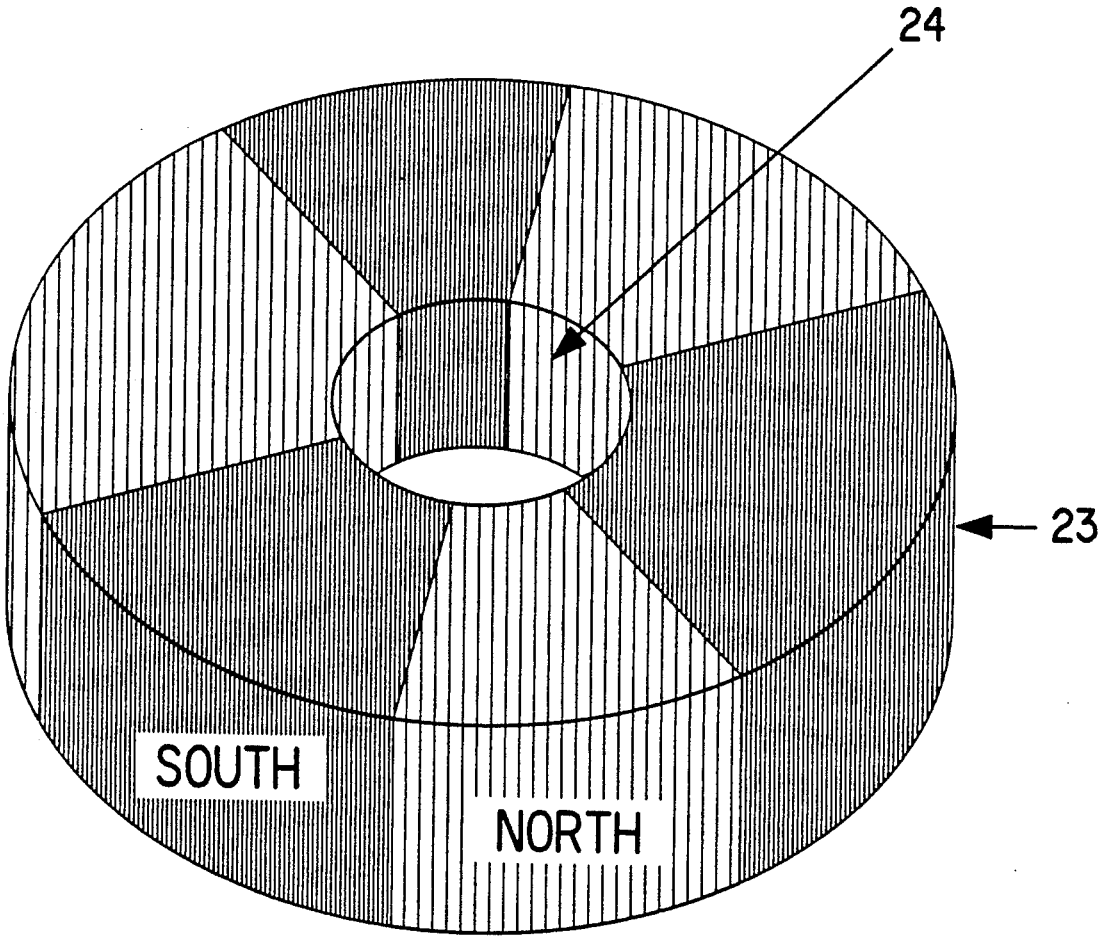
FIG. 2 shows a disc magnet with alternating radial magnetization.
Figure 3:
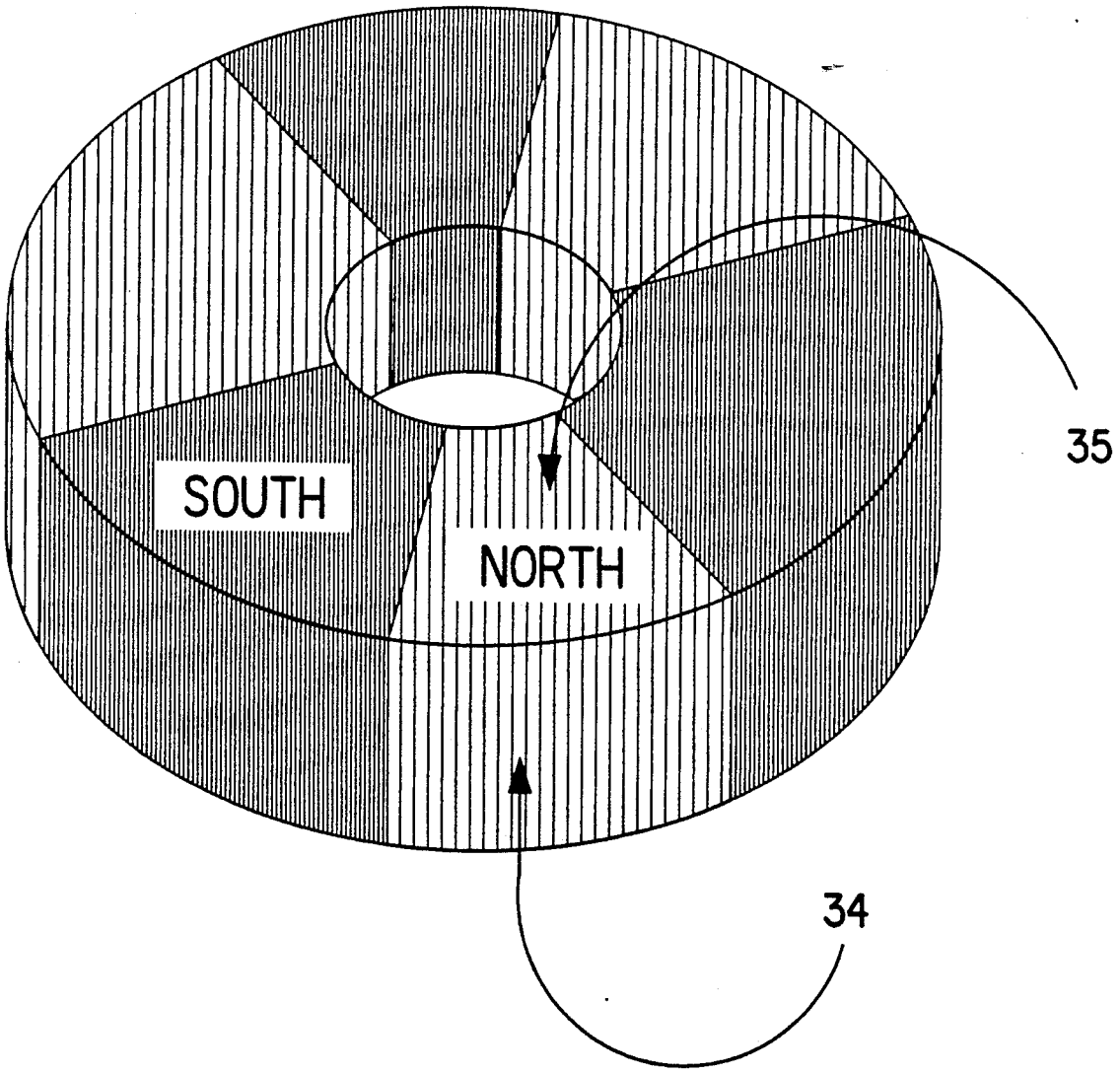
FIG. 3 shows a disc magnet with alternating axial magnetization.

In other embodiments of the present invention, the impellers are in the form of discs which can be axially or radially magnetized. Each disc can be divided, if desired, into radial sections which alternate in the direction of their radial or axial magnetic field. FIG. 2 shows a magnetic disc with alternating radial magnetized sections. In FIG. 2 the magnetic field is oriented from side edge 23 radially through to center face 34. FIG. 3 shows a disc with alternating axial magnetized sections. In this case the magnetic field is oriented from the North magnetic pole face 33 axially through to the opposite South magnetic pole face 34. FIGS. 2 and 3 show the disc divided into eight sections, with alternating north and south magnetic poles on adjacent sections around the disc. In this way, the magnetic field outside of the magnet becomes more non-uniform, thereby increasing the magnetic body force on the media.

In a particular embodiment of the present invention the magnetization of the media is imparted by uniformly magnetized impellers, each impeller will typically have a magnetic flux density of at least about 100 Gauss in a media mill having a diameter of about four inches, and having four or five impellers on a central shaft which are circular discs with a diameter of about three inches and a thickness of about 0.33 inch, and using spherical steel media having a diameter of 0.8 mm. To avoid the additive effect of several magnetic impellers in measuring the magnetic flux density from each magnet, the magnetic flux density should be measured on the face of the disc magnet when separated from the mill in free space.

Figure 4:
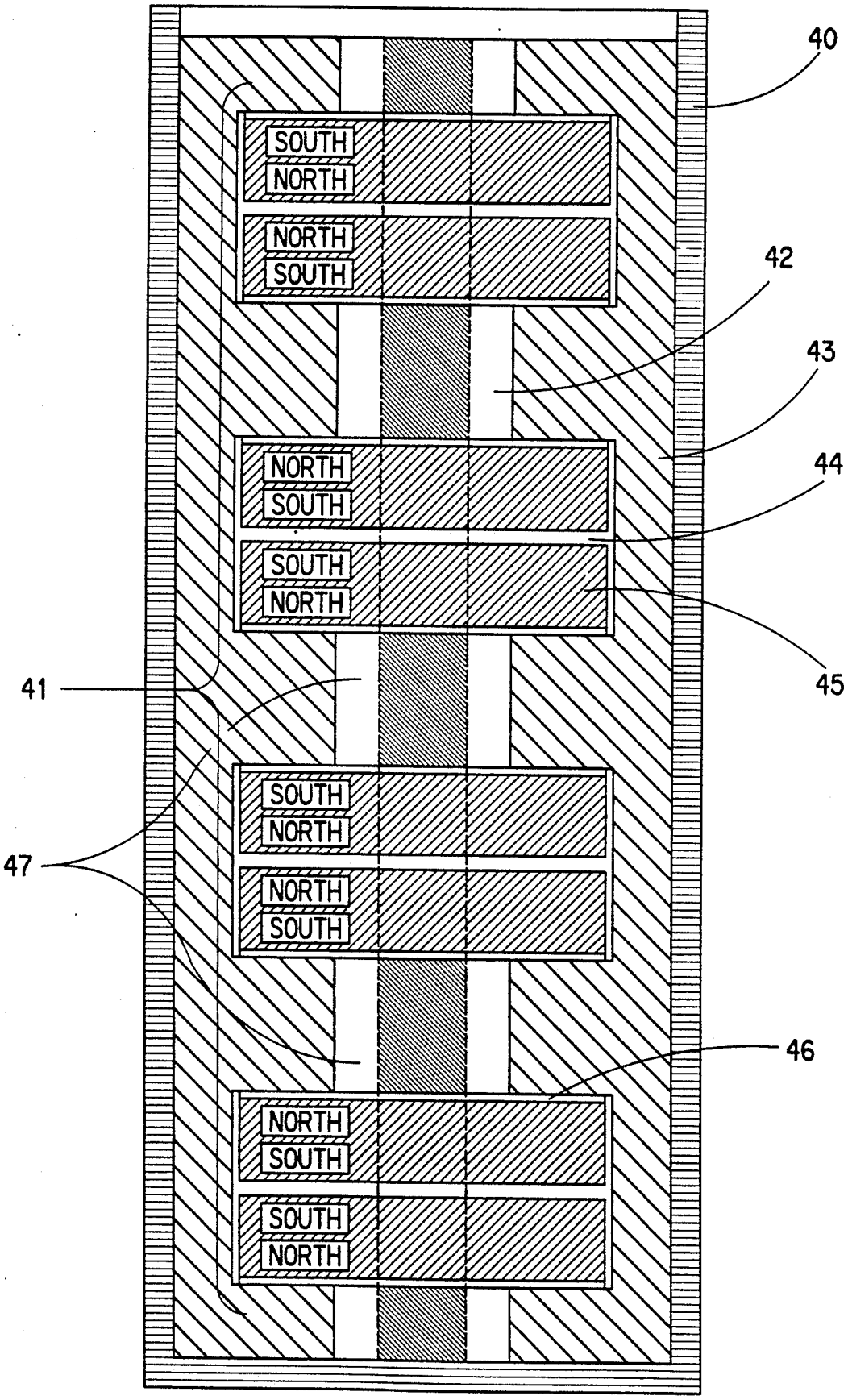
FIG. 4 shows a cross-section of a preferred media mill having permanent magnetic discs enclosed in cups.

One preferred embodiment of the invention can be more fully understood by reference to FIG. 4, in which a cross sectional representation of a magnetic media mill is shown. The mill has the general configuration of a right circular cylinder, comprising magnetizable outer shell 40 having rotatable multi polar agitator 41 positioned in the shell 40. The agitator 41 has central shaft 42 and impeller discs 43 concentrically mounted thereon. Each disc is composed of a magnetizable steel cup 44 which is mounted on the shaft 42. A commonly available ceramic ring magnet 45 is placed in each cup 44, with like magnetic poles facing each other. The exposed surface of each magnet is covered with a non-magnetizable coverplate 46 (such as Inconel 600 ®) or a magnetizable coverplate to prevent contact of product being ground with the ring magnet 45. Each impeller disc 43 is mounted in such a way that the magnet faces of each adjacent cup attract each other. In general, the disc impeller 43 will extend to a diameter that results in sufficient magnetic field and shear zone in the annulus.

The present invention provides a media mill that permits easy fluidization of the media, which is less dependent on flow rate and media load, and provides faster and more efficient milling performance than has heretofore been attainable with conventional media mills.

The present invention is further illustrated by the following specific Examples.

EXAMPLES

In examples 1-3 an open head (atmospheric) media mill having a chamber diameter of 4 inches and length of 9 inches was mounted so that an interchangeable shaft could be positioned in the mill and attached to a motor drive. Various permanent magnet discs were assembled using configurations similar to that shown in FIG. 4 and described in more detail in each of examples 1-3 below. (Each magnetic disc can have either a single cup or double cup configuration which accomodates either one magnet or two magnets respectively). All the magnetic discs shown in FIG. 4 are of a double cup configuration. In a double cup the magnetization of each magnet can be either in the same or opposite directions. Adjacent cups can have the same or opposite magnetization directions. The cups could be covered with highly magnetizable material. Single cup configurations used in conjunction with a double cup configuration were used in Examples 1 and 4 as described below. As a control the magnetic discs were replaced with equivalent geometry non-magnetic discs and comparative examples were also run.

The particle size of the dispersion (i.e. grinding efficiency) was characterized by a measurement of relative transparency of a film drawdown on a glass plate compared to a standard drawdown made from the standard nonmagnetic process. The relative transparency was measured on a Hunter "Color Quest" spectrophotometer.

Example 1

Magnetization was provided by the use of permanent magnet discs inside magnetizable steel cups as the impellers. The discs were arranged similarly to those shown in FIG. 4. The ceramic ring magnets were 0.4 inch thick strontium ferrite permanent magnetic ceramic discs having a diameter of 2.8 inches (available from Job Master Magnets as two 0.2 inch thick magnets) inserted into magnetizable steel cups having a diameter of 3 inches. Five discs were used with an alternating double cup then single cup (three double cups and two single cups). The spacing between each disc was one inch. The double cup used magnets oriented so that the north pole on one face and the south pole of the other face contacted the center plate of the cup. The annulus between the magnetic discs and the wall of the mill was 0.5 inches.

Figure 5:
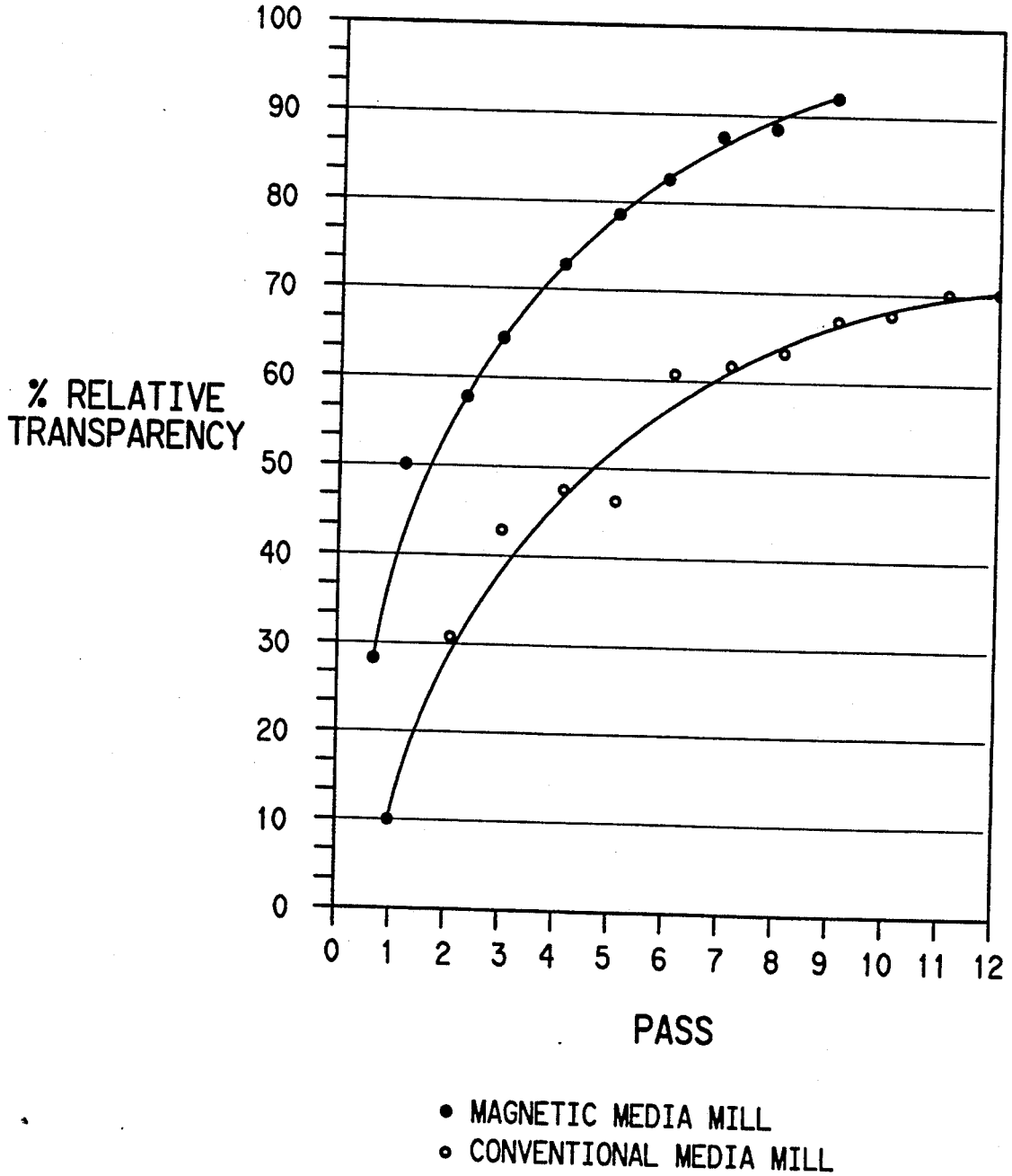
FIG. 5 shows a graphical representation of the performance of a magnetic media mill vs. a non-magnetic media mill from Example 1.

The mill was filled with 5730 grams of 0.8 mm spherical steel media, and operated at 1675 revolutions per minute. Cooling water was supplied to the outer shell of the mill to control batch temperature during grinding to about 120° F.-130° F. In this example 3 gallons of pigment dispersion of Perrindo Maroon pigment (R6434) manufactured by Mobey Chemical Co. (the composition of the Perrindo Maroon Pigment premix is shown below in Table 1) was prepared by passing the premix through the magnetic media mill. Similarly, an identical premix was passed through a non-magnetic set of discs to compare equivalent disc geometry design without magnetic effects. The results are shown in FIG. 5. This figure plots the Relative Transparency of the pigment dispersion versus the number of passes. (A pass represents the pigment dispersion passing completely through the processing unit).

TABLE - 1

| Perrinda Maroon Pigment Dispersion | |
|---|---|
| | Weight % |
| Butyl Acetate | 30.55 |
| Acrylic Resin | 29.25 |
| Xylene | 12.54 |
| Acrylic Dispersing Resin | 2.34 |
| Toluene | 1.92 |
| Perrinda Maroon Pigment | 23.40 |
| Total | 100.00 |

Example 2

Figure 6:
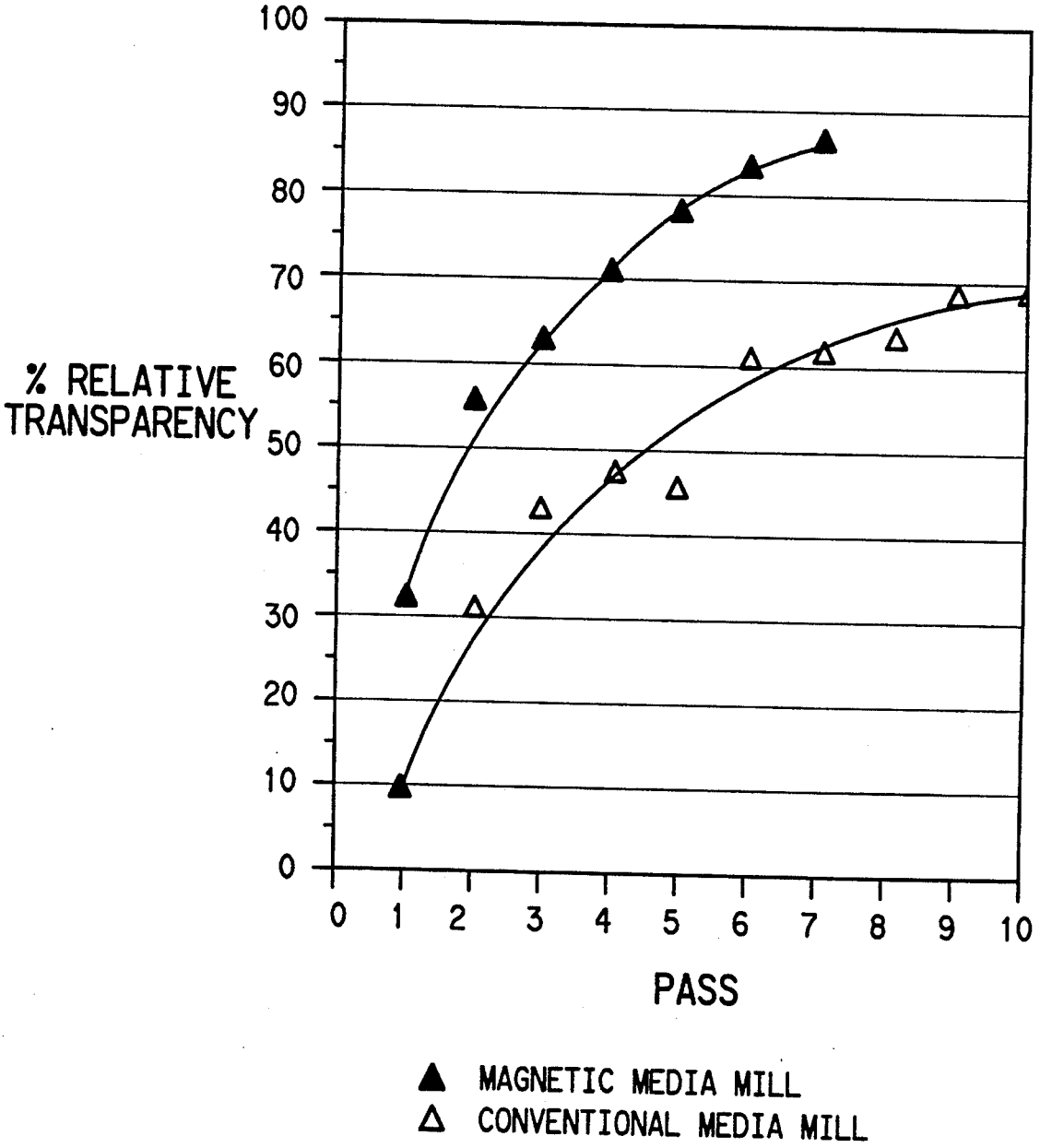
FIG. 6 shows a graphical representation of the performance of a magnetic media mill vs. a non-magnetic media mill from Example 2.

This example incorporates exactly the same equipment, dispersion and grinding media and temperatures as described in Example 1, except four double magnetizable steel cups (no single cups) were spaced 1.25 inches apart. Each disc was assembled with alternating north poles of both magnets facing each other in one cup followed by south poles of both magnets facing each other in an adjacent cup on the agitator. In this example (as opposed to Example 1), the exposed magnet faces were covered with non-magnetizable stainless steel cover plates to prevent abrasion and wear of the magnet material. Comparison of the magnetic intensified design versus a duplicate geometry non-magnetic agitator design using the same preemix is shown in FIG. 6.

Example 3

Figure 7:
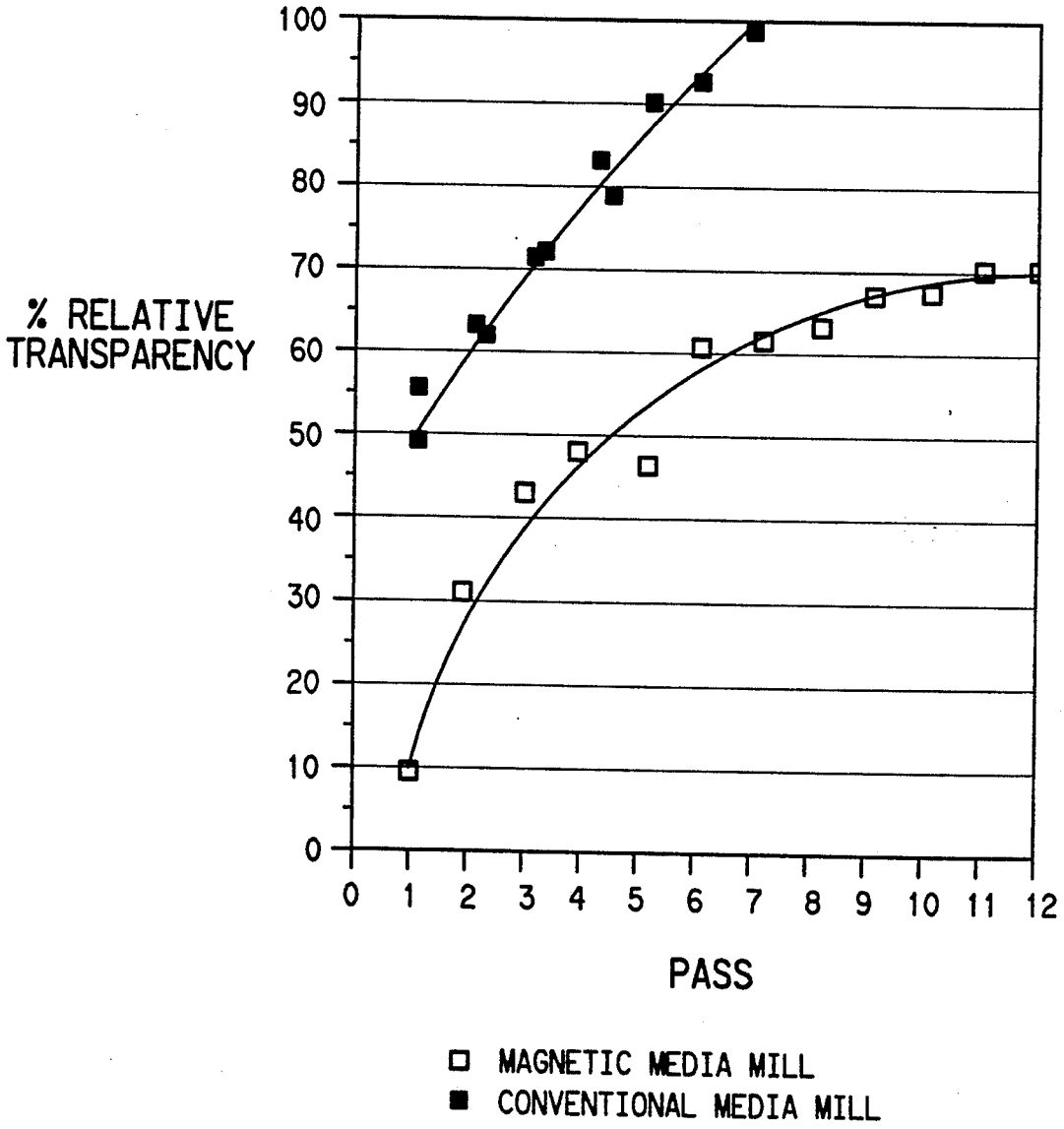
FIG. 7 shows a graphical representation of the performance of a magnetic media mill vs. a non-magnetic media mill from Example 3.

This example incorporates the same equipment, dispersion and grinding media described in example 2, except a closer spacing of 0.825 inches between adjacent discs on the agitator was used and it was run at 140° F.-150° F. This permits an extra (fifth) double magnetic disc to be used in the same vertical spacing as in Example 2, in addition to increasing the magnetic flux density of all discs on the agitator due to synergistic effects of all the magnets being in a closer proximity to each other. Comparison of the magnetic intensified design versus the duplicate geometry non-magnetic agitator design using the same premix is shown in FIG. 7.

Example 4

Figure 8:
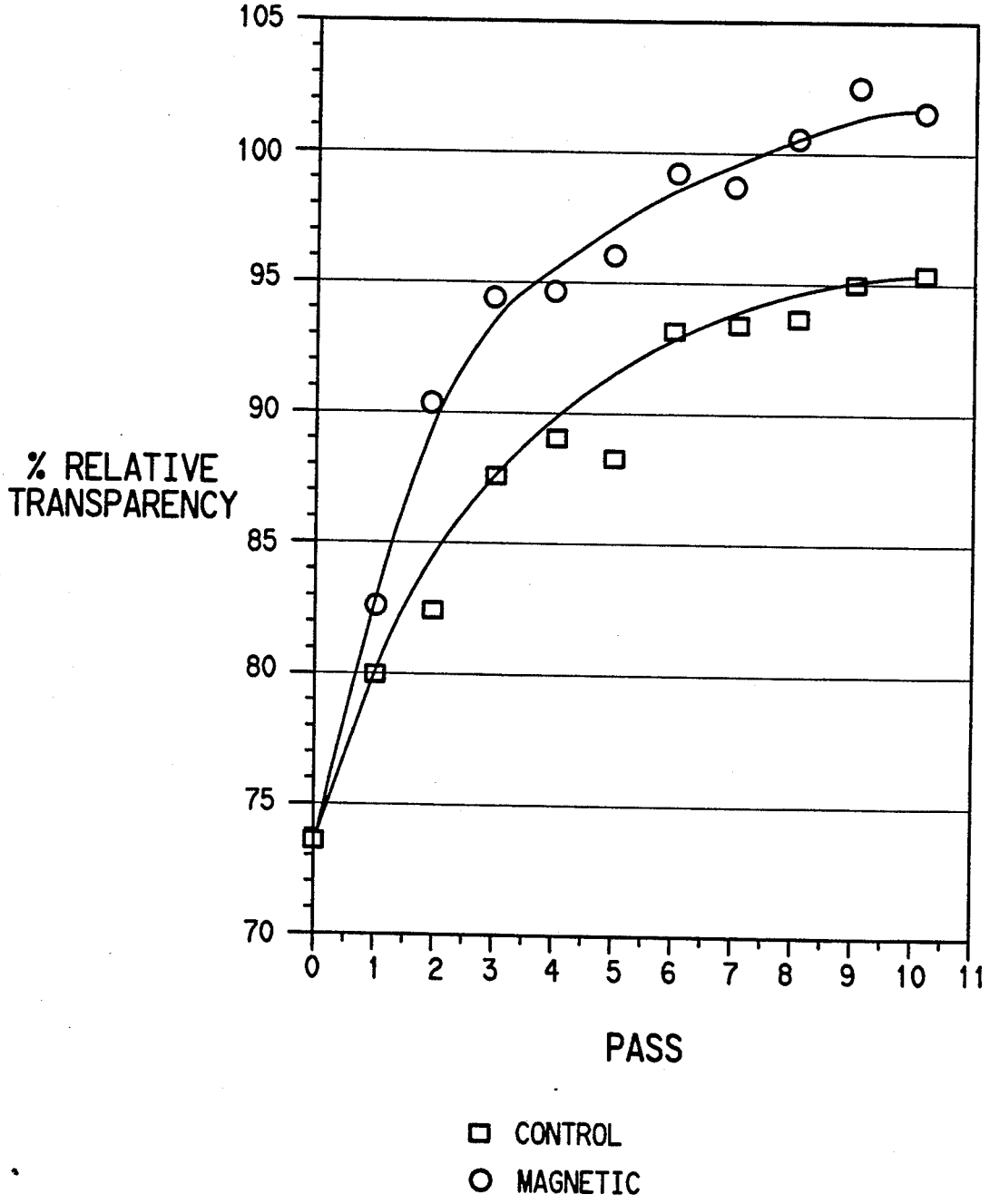
FIG. 8 shows a graphical representation of the performance of a magnetic media mill vs. a non-magnetic media/mill from Example 4.

In this example, 20 gallons of pigment dispersion of Perrinda Maroon pigment as described in Example 1 above was prepared by passing through a F-600 Schold Shot mill manufactured by Schold Machine Co. The standard operating conditions of the Schold Mill is shown in Table 2. Next 20 gallons of the same pigment dispersion using the same premix was prepared by passing through the same mill except that the disk assembly was replaced by a magnetic disk assembly operating at the shaft revolution per minute and media load shown in Table 3. The magnets were ceramic rings (5 inches in diameter by 0.625 inch thick) available from Duramagnetics Corporation. The magnetic rings were axially magnetized through the thickness with a surface flux density of 500 to 900 Gauss on the exposed surface measured near the outer edge of the magnet in the mounted position. There were nine different discs mounted in the Schold Mill with an alternating double cup/single cup configuration (five double cups and four single cups), spaced 1.25 inches apart on the agitator shaft. The magnets (double cups or single cups) are assembled on the shaft in such a way that all magnet faces are attracting (i.e. north pole to south pole). Comparison of the magnetic intensified design versus the duplicate geometry, non-magnetic agitator design using the same premix is shown in FIG. 8.

TABLE - 2

| Standard Operating Conditions | |
|---|---|
| 1. | Staggered 9 Disk Assembly option supplied by Schold Machine Co. (Disks closer together at bottom of mill). |
| 2. | 1850 ± 50 revolutions per minute shaft speed. |
| 3. | 67 pounds of 0.0330 inch diameter steel shot (Schold Machine Co. #330 SMOS) 46-48 Rockwell C hardness. |
| 4. | Flow rate - 9 to 10.5 gallons per hour. |
| 5. | Product Temperature 94 to 102 degrees Fahrenheit. |
| 6. | Carbon Steel Shell. |

TABLE - 3

| Magnetic Disk Operating Conditions | |
|---|---|
| 1. | 9-Magnetic Disks as described above |
| 2. | 1650 ± 100 revolutions per minute shaft speed. |
| 3. | 58 pounds of 0.0330 inch diameter steel shot (Schold Machine Co. #330 SMOS) 46–48 Rockwell C hardness. |
| 4. | Flow rate - 9.7 to 10.3 gallons per hour. |
| 5. | Product Temperature - 100 to 110 degrees Fahrenheit. |
| 6. | Carbon Steel Shell. |

Example 5

A media mill was constructed and mounted on a drill press to provide rotational power for the rotating agitator. The mill consisted of an exterior shell in the shape of a covered right circular cylinder, jacketed for cooling by the circulation of a cooling fluid. The mill contained an agitator having five impeller fingers mounted on a central shaft, at alternating right angles. The mill had a capacity of about 1 liter.

The mill was placed into a circular electromagnet having an outer diameter of 8.5 inches and an inner diameter of 4 inches. The electromagnet was a commercially available DC induction coil which, operated on 115 volts and 1.2 amps, has a rated capacity of 1000 Gauss. The voltage for the electromagnetic coil was rectified by an AC/DC converter having a variable voltage supply. The average magnetic flux density of the media was found to be about 250 Gauss, as measured on the dry media in the mill with the electromagnet operated at a level of 25% of capacity.

Into the mill were placed 1680 grams of steel shot having a diameter of 0.8 mm, and 350 grams of premix dispersion consisting of commercially available phthalocyanine blue toner in acrylic resin with a mixture of solvents and a total solids content of 42%. The dispersion consisted of the following components:
acrylic resin solution: 42.86 weight %
xylene: 45.14 weight %
blue pigment: 12.00 weight %

The premix dispersion had been preprocessed to a stable condition of about 70% of the final desired degree of dispersion quality.

Figure 9:
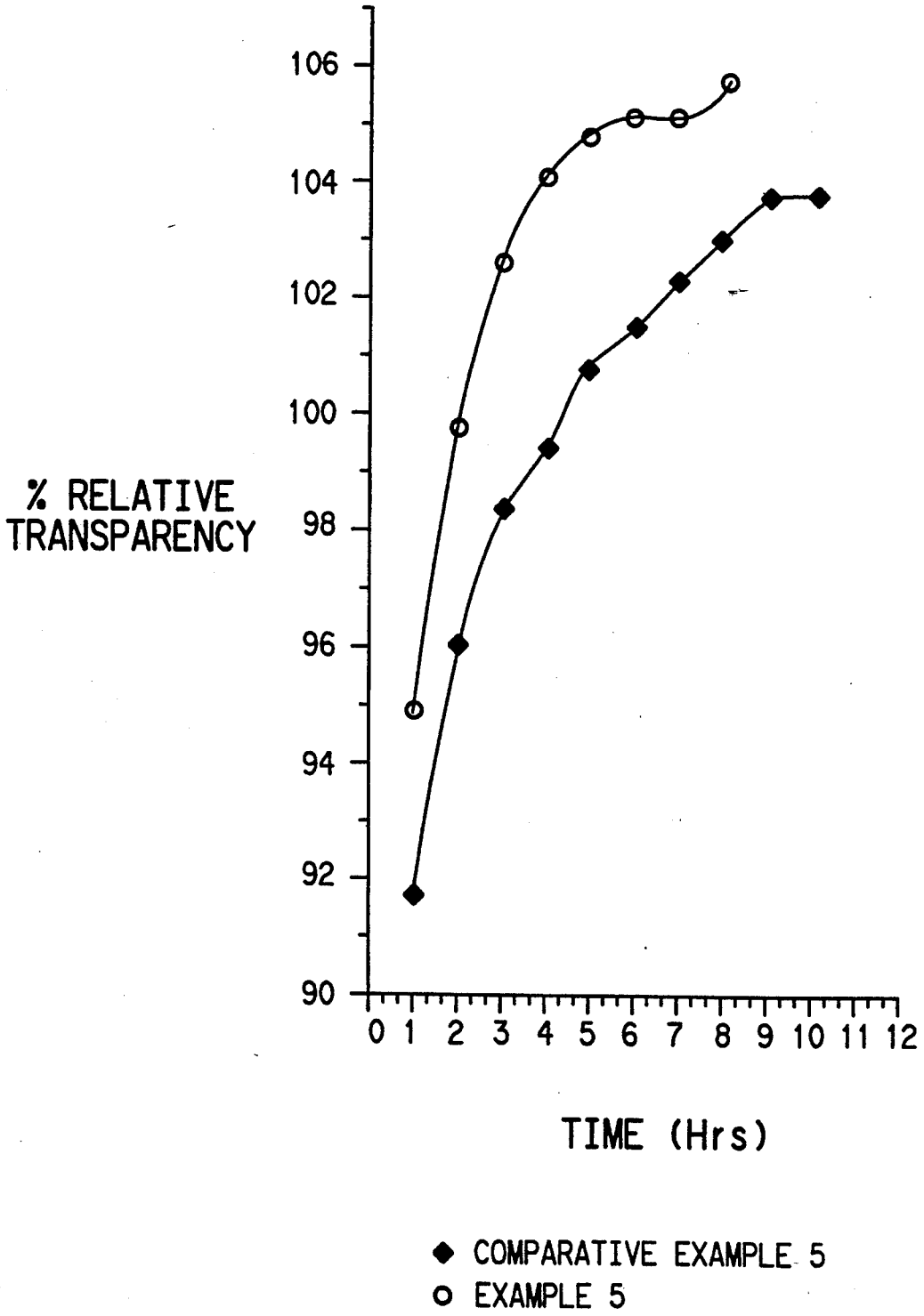
FIG. 9 shows a graphical representation of the performance of a magnetic media mill vs. a non-magnetic media mill from Example 5.

The agitator was rotated at 350 rpm, and the dispersion was periodically sampled and evaluated by 3 mil (thousandth of an inch) wet drawdown on glass, and evaluated for transparency. The results of this evaluation are summarized in FIG. 9, in which higher transparency indicates more complete dispersion.

As a control, the above procedure was repeated, except that the electromagnet was not used. The results of the media were similarly evaluated, and also summarized in FIG. 9.

Example 6

A media mill was constructed and mounted on a drill press to provide rotational power for the rotating agitator. The mill consisted of an exterior shell in the shape of a covered right circular cylinder, jacketed for cooling by the circulation of a cooling fluid. The mill had a capacity of about 1 liter. Magnetization was provided by the use of permanent magnet discs for the impellers. The impellers were two barium ferrite permanent magnetic ceramic discs having a thickness of ½ inch each and a diameter of 4 inches, in a mill having a diameter of 6 inches. The discs each had a north pole on one face and a south pole on the other. Measurement of the magnetic flux density on the surface of each magnet was about 1000 Gauss. The magnetic flux density in the media varied according to the distance from the impellers, and was found to be about from 150 to 350 Gauss, as measured on the dry media. The discs were used in pairs, positioned so as to have opposite magnetic poles facing each other, and mounted on the shaft about 1 and ½ inches apart.

The mill was filled with 11 pounds of 0.8 mm spherical steel media. 350 grams of premix dispersion was used consisting of commercially available phthalocyanine blue toner in acrylic resin with a mixture of solvents and a total solids content of 42%. The dispersion consisted of the following components:
acrylic resin solution: 42.86 weight %
xylene: 45.14 weight %
blue pigment: 12 weight %
The premix dispersion had been preprocessed to a stable condition of about 70% of the final desired degree of dispersion quality.

Figure 10:
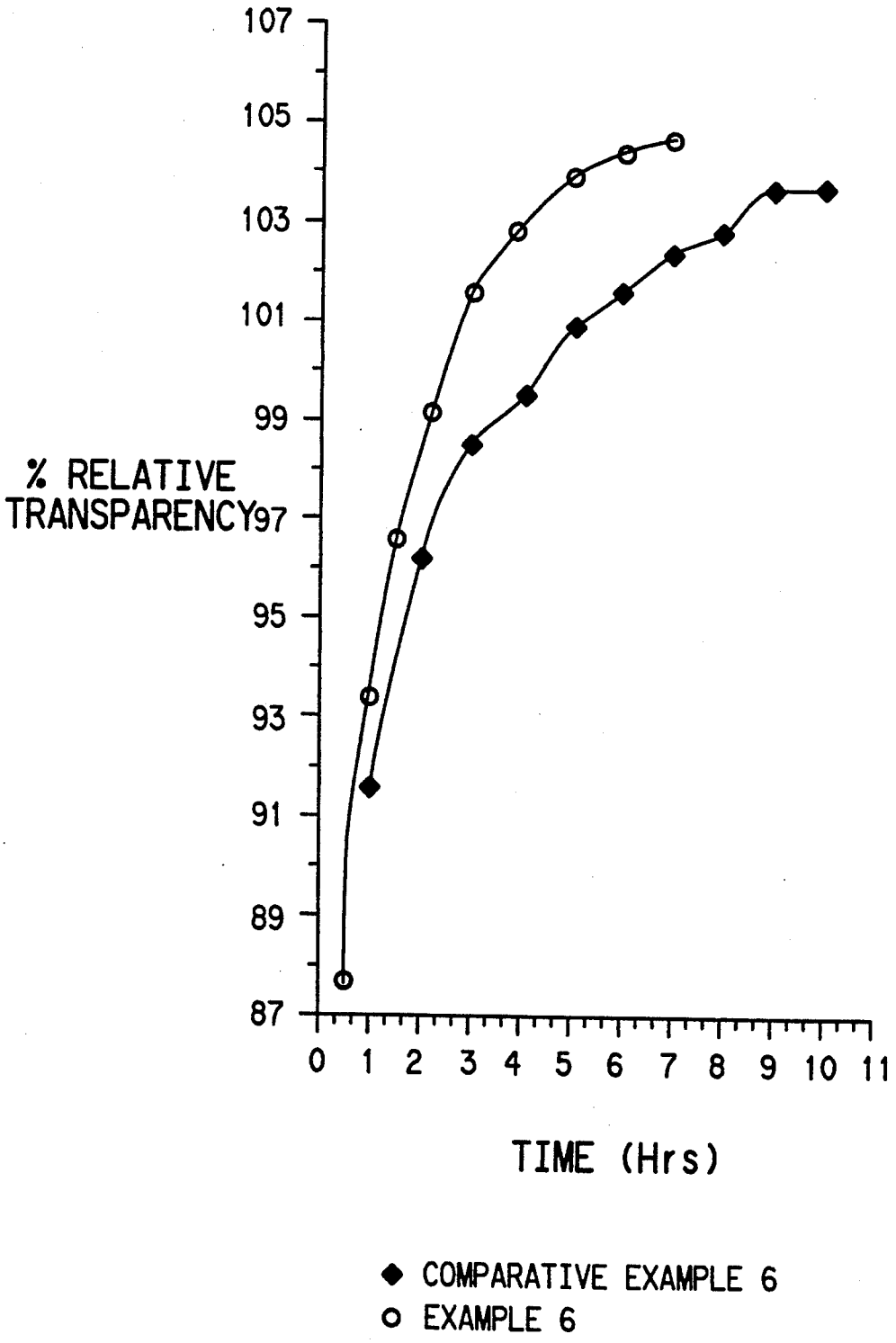
FIG. 10 shows a graphical representation of the performance of a magnetic media mill vs. a non-magnetic media mill from Example 6.

The agitator was rotated at 350 rpm and the dispersion was periodically sampled and evaluated for transparency. The results of this evaluation are summarized in FIG. 10 in which higher transparency indicates more complete dispersion.

As a control Example, the above procedure was repeated replacing the magnetic agitator with a non-magnetic agitator of the same geometry. The results of the media transparency were similarly evaluated, and also summarized in FIG. 10.

We claim:

1. In a media mill of the type comprising a magnetizable container, a rotatable multi-polar magnetic agitator within the magnetizable container, the multi-polar magnetic agitator having a central shaft and a plurality of impellers on the shaft at least some of the impellers being magnetic, and magnetizable media within the container, wherein the media particles are sufficiently magnetized by the magnetic agitator so that grinding efficiency is improved and the media particles are present in such quantity as to provide a media volume of at least about 25%.

2. A media mill of claim 1 wherein the media are magnetized by a substantially spatially uniform, time invariant magnetic source.

3. A media mill of claim 2 wherein the magnetic source is at least one permanent magnet.

4. A media mill of claim 3 where some of the permanent magnets on the impeller are enclosed within magnetizable cups.

5. A media mill of claim 4 where the permanent magnets within the magnetizable cups are magnetized in the same direction.

6. A media mill of claim 4 where the permanent magnets within the magnetizable cups are magnetized in opposite directions.

7. A media mill of claim 3 where at least some of the permanent magnets on the agitator are axially magnetized.

8. A media mill of claim 7 where at least some the axially magnetized magnets on the agitator are broken into sections with alternating directions of axial magnetization.

9. A media mill of claim 3 where at least some the permanent magnets on the agitator are radially magnetized.

10. A media mill of claim 9 where at least some the radially magnetized magnets on the agitator are broken into sections with alternating directions of radial magnetization.

11. A media mill of claim 3 where some of the permanent magnets are radially magnetized and some of the permanent magnets are axially magnetized.

12. A media mill of claim 3 wherein the permanent magnet is at least one impeller of the mill.

13. A media mill of claim 12 wherein the impellers are magnetized to a magnetic flux density of at least about 100 Gauss.

14. A media mill of claim 12 wherein the impellers are magnetized to a magnetic flux density of at least about 1000 Gauss.

15. A media mill of claim 1 wherein the media are magnetized by a substantially spatially uniform, time variant magnetic source.

16. A media mill of claim 1 wherein the media are magnetized by a substantially spatially non-uniform, time invariant magnetic source.

17. A media mill of claim 1 wherein the media are magnetized by a substantially spatially non-uniform, time variant magnetic source.

18. A media mill of claim 1 wherein the media are magnetized to a magnetization intensity of at least about 25 Gauss.

19. A media mill of claim 1 wherein the average intensity of magnetization of the media is less than the amount which will cause the media to assume a locked configuration.

20. A media mill of claim 19 wherein the media is steel and the average intensity of magnetization of the media is less than about 500 Gauss.

21. A media mill of claim 1 wherein the media consist essentially of substantially spherical steel shot having a diameter of about from 0.1 to 3.0 mm.

22. A media mill of claim 1 wherein the media consist essentially of magnetizable ceramic.

23. A media mill of claim 22 wherein the ceramic comprises zirconium compounds.

24. A media mill of claim 22 wherein the ceramic consists essentially of at least one compound selected from zirconia silicates.

* * * * *